United States Patent [19]

Le Guillou

[11] 4,030,667

[45] June 21, 1977

[54] PUSH-BUTTON HAVING A CALIBRATED OUTLET FOR A CONTAINER UNDER PRESSURE

[75] Inventor: Felix Francois Le Guillou, Le Neubourg, France

[73] Assignee: Establissements Valois S.A., Le Neubourg, France

[22] Filed: June 5, 1975

[21] Appl. No.: 584,229

[30] Foreign Application Priority Data

June 5, 1974 France ..... 74.19302

[52] U.S. Cl. ..... 239/573; 239/579; 239/590.3

[51] Int. Cl.² ..... B05B 1/34

[58] Field of Search ..... 222/402.21, 402.22, 222/402.23, 402.24, 189; 239/573, 579, 590.3

[56] References Cited

UNITED STATES PATENTS

| | | | |
|---|---|---|---|
| 2,709,111 | 5/1955 | Green | 222/402.22 |
| 2,761,833 | 9/1956 | Ward | 222/189 X |
| 2,783,091 | 2/1957 | Haldy | 222/189 |
| 3,061,203 | 10/1962 | Kitabayashi | 222/402.24 X |
| 3,149,758 | 9/1964 | Bush et al. | 222/189 |
| 3,194,449 | 7/1965 | Kaiser et al. | 222/402.24 X |
| 3,209,954 | 10/1965 | Webster | 222/189 |
| 3,219,069 | 11/1965 | Kutter | 222/402.22 X |
| 3,704,725 | 12/1972 | Marand | 222/189 X |
| 3,756,472 | 9/1973 | Vos | 222/189 |
| 3,854,636 | 12/1974 | Conway et al. | 222/402.24 |

*Primary Examiner*—Stanley H. Tollberg
*Assistant Examiner*—Norman L. Stack, Jr.
*Attorney, Agent, or Firm*—Sughrue, Rothwell, Mion, Zinn & Macpeak

[57] ABSTRACT

The present invention relates to valves for pressurized containers used for atomizing products such as alcoholic or aqueous lotions, such as, pharmaceutical products.

According to the invention, a caliber reducer (7) is disposed at the outer end of the discharge tube (3).

By limiting the dischage rate it is possible to prevent the formation of an undivided jet or solid discharge stream and to control the atomization process when pressure is removed from the button.

1 Claim, 1 Drawing Figure

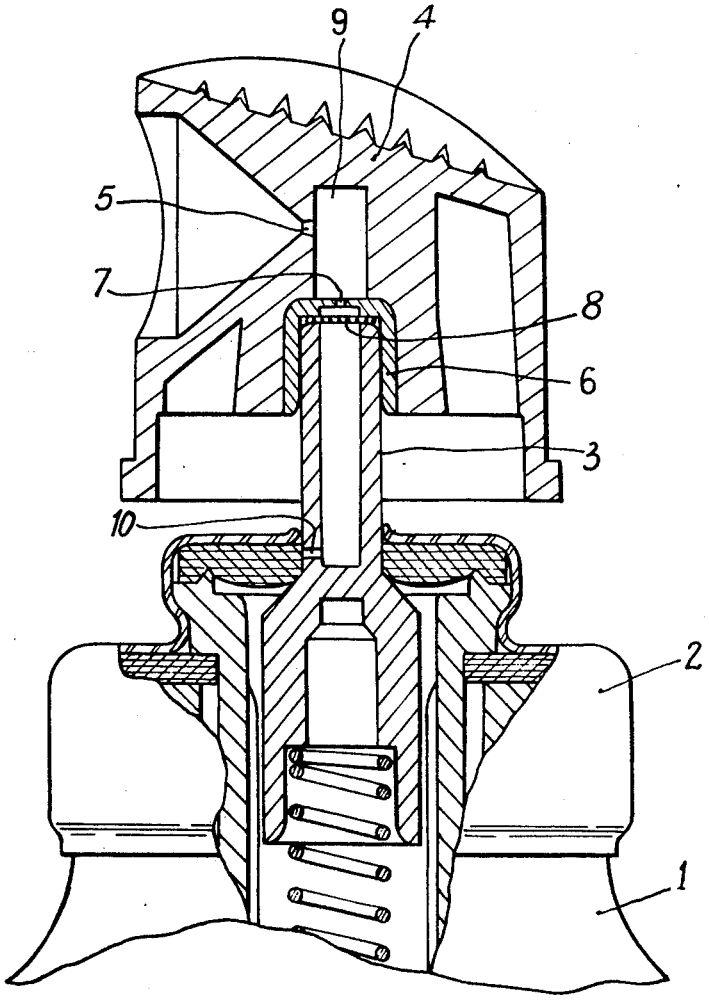
9
4
5
7
8
6
3
10
2
1

PUSH-BUTTON HAVING A CALIBRATED OUTLET FOR A CONTAINER UNDER PRESSURE

BACKGROUND OF THE INVENTION

1. Field of the Invention

The present invention relates to push buttons for pressurized aerosol containers for atomizing liquids. More particularly, it relates to containers of this type which contain a liquid product to be discharged wherein the ejection of the liquid product is effected under the influence of the pressure of a propulsive gas (for example, nitrous oxide or carbon dioxide) which is soluble in the liquid to be atomized (alcohol or water—either in pure form or in a mixture—can form the main constituents of the liquid). When the user opens the liquid discharge opening by depressing or tilting the push button, the liquid which is saturated in propulsive gas rushes through the push button under the action of the internal pressure of the propulsive gas and is atomized by the distribution opening of the push button and by the elastic force of the propulsive gas dissolved in the liquid to be vaporized. When the pressure exerted on the push button is reduced, a non-vaporized jet of liquid is frequently produced and there may even be an overflow on the push button.

Thus, the user who operates his atomizer notices the following phenomena: by actuating the control member (push button) he discharges a finely divided jet of liquid. When pressure is no longer applied to the control member an undivided jet of liquid and an overflow on the push button are produced. The resultant effect is disagreeable.

2. Description of the Prior Art

Numerous devices have been developed to obviate the above disadvantage such as valves which ensure that gas is present on termination of use to discharge under pressure the liquid contained in the push button and to ensure total vaporization.

SUMMARY OF THE INVENTION

According to the invention it was found that by limiting the delivery to a very precise value upstream of the distribution opening (spray nozzle) of the push button (which must be at a higher value), it was possible for the propulsive gas dissolved in the product to be vaporized to be desorbed between these two distribution openings and to eliminate a non-atomized jet when pressure is removed from the push button.

According to an important feature of the present invention, the adjustable push button on the discharge tube (valve) of a pressurized container of the type in point comprises a delivery-limiting spray nozzle having a circular opening with a diameter of 0.20–0.30 mm and preferably, of ca. 0.25 mm, for the alcohol. As there is a fairly high risk of this type of nozzle being blocked by foreign bodies, a protective filter or screen comprising calibrated holes is provided according to the invention.

Other objects, features and advantages of the present invention will be made apparent in the following detailed description of a preferred embodiment thereof provided with reference to the accompanying drawing.

BRIEF DESCRIPTION OF THE DRAWING

The single FIGURE is an axial sectional view of a cap of a pressurized container according to the invention.

DESCRIPTION OF THE PREFERRED EMBODIMENT

The container 1 is fitted with a valve 2 comprising a discharge tube 3. In the rest state this discharge tube 3 is situated inside the container. A distribution opening is opened through depression or tilting of a control member to enable the product under pressure in the container to be discharged. The control member (or push-button) 4 comprising an atomization opening 5 and an expansion chamber 9 is disposed at the top part of the tube 3.

According to the invention, the central part 6 of the push-button 4 encasing the end of the tube 3 is perforated by a hole 7, the diameter of which is smaller than the atomization opening 5. In the case of alcoholic or aqueous products it was found that a hole having a diameter of 0.25 mm produced very good results. A very fine mesh screen 8 is disposed in the bottom of the central part 6 of the push-button 4. This screen 8, for example, a metal screen, is designed to arrest foreign bodies, dirt, dust particles, impurities or other such objects which are capable of stopping up the hole 7. In actual fact, a waste product of this kind can obstruct a part of the screen without substantially reducing the free section of the screen and reducing the quality of the atomization process. A device of this type produced excellent results and operated correctly in a continuous manner without any noticeable pressure drop, untimely stoppage or projection of droplets.

By virtue of this device and the fact that the hole 10 of the tube 3 has a large diameter, rapid filling is rendered possible.

What is claimed is:

1. In an aerosol valve for atomizing a liquid having a propulsive gas dissolved therein, and including a cap member adapted to be sealingly secured to a top opening of a pressurized container for the liquid and dissolved gas, a hollow, depressable valve stem slidingly extending upwardly through the cap, said valve stem being open at its upper end, closed at its lower end, and having a passageway through a wall thereof communicating with the hollow interior of the stem whereby the liquid and dissolved gas may be charged into or discharged from the container when the valve stem is depressed, and means biasing the valve stem upwardly against the cap member, the improvements characterized by:

a. a push-button having a recessed end for removable fit over the upper end of the valve stem, b. a hollow expansion chamber formed within the push-button, opening to the recess and configured to form a continuation of the hollow valve stem when the push-button is mounted thereon, c. a spray nozzle within said push-button, and opening laterally to said hollow expansion chamber, d. an atomizing opening communicating the expansion chamber and the spray nozzle, e. means within the recess face of said push-button for defining a small diameter orifice at the lower end of the expansion chamber, said orifice having a diameter smaller than that of the atomizing opening, serving as the sole means of fluid communication between the hollow valve stem and the expansion chamber, such that said orifice permits continued expansion of the liquid and dissolved gas in the expansion chamber after push-button release and thereby preventing a solid liquid discharge stream, the formation of large liquid droplets, and the overflow of liquid from the spray nozzle when the push-button is released after a discharge operation, and f. a filter screen disosed within said recess and overlying and adjacent to and being upstream of said orifice.

* * * * *